US005440892A

United States Patent [19]

Tatematsu et al.

[11] Patent Number: 5,440,892

[45] Date of Patent: Aug. 15, 1995

[54] AUGER-TYPE ICE MAKING MACHINE

[75] Inventors: Susumu Tatematsu, Nagoya; Kazuhiro Mori, Toyoake; Hideyuki Ikari, Kariya, all of Japan

[73] Assignee: Hoshizaki Denki Kabushiki Kaisha, Aichi, Japan

[21] Appl. No.: 294,841

[22] Filed: Aug. 29, 1994

[51] Int. Cl.[6] ..... F25C 1/14

[52] U.S. Cl. ..... 62/135; 62/354

[58] Field of Search ..... 62/135, 137, 354

[56] References Cited

U.S. PATENT DOCUMENTS 4,982,573 1/1991 Tatematsu et al. ..... 62/135

4,986,081 1/1991 Hida et al. ..... 62/135 X

*Primary Examiner*—William E. Tapolcai

*Attorney, Agent, or Firm*—Wenderoth, Lind & Ponack

[57] ABSTRACT

An auger-type ice making machine includes a refrigerating cylinder 5, an auger 6 disposed rotatably within the refrigerating cylinder 5 and provided with a spiral blade 6a, a driving motor 8 for driving rotatively the auger 6 and an electric heater mounted around an outlet end portion of the refrigerating cylinder into and through which ice is transported under the effect of rotation of the auger. A coolant vaporizing tube is wound around outer periphery of the refrigerating cylinder, and raw water is fed into the refrigerating cylinder via a feed water pipe. When jamming of ice takes place within the refrigerating cylinder 5, an overcurrent flows through the driving motor 8. The overcurrent is detected by a protector 23 incorporated in a control circuit 30, whereupon the electric heater 22 is electrically energized.

18 Claims, 12 Drawing Sheets

AUGER-TYPE ICE MAKING MACHINE

BACKGROUND OF THE INVENTION

1. Field of the Invention

The present invention generally relates to an auger-type ice making machine. More particularly, the invention is concerned with an improvement of an auger-type ice making machine such that protection can be secured for a driving motor and other components upon occurrence of jamming of ice or the like obstructive phenomenon within a refrigerating cylinder of the ice making machine while providing measures for speedily clearing away such unwanted phenomena without fail.

2. Description of the Related Art

In a so-called auger-type ice making machine, raw water (i.e., water used for manufacturing ice) is fed into a refrigerating cylinder around which a coolant vaporizing tube communicated to a refrigerating circuit is wound, wherein an ice layer grown on an inner wall surface of the refrigerating cylinder is scraped off by a spiral blade extending spirally around an auger which serves for transporting ice thus detached upwardly to an exit or outlet port as well. Because of capability of manufacturing flake-like ice chips as well as ice pellets or cubes formed by compressing the ice chips, the auger-type ice making machine is widely used.

In this type ice making machine, a press head assembly is installed at an outlet provided at a top end of the refrigerating cylinder in order to dewater and solidify the ice chips under pressure. Consequently, jamming of ice may occur within the press head assembly and the refrigerating cylinder for a variety of causes. When such an ice jamming phenomenon takes place, the cylinder is subjected to an excessively large load, which may often result in burning or the like damage of an auger driving motor such as a geared motor. As the measures for coping with this problem, there is proposed a technique according to which lowering of a pressure for coolant vaporization due to the ice jamming is detected, whereupon a high-temperature gas (also referred to as hot gas) is fed into the coolant vaporizing tube to thereby melt or fuse the clogging ice, as is disclosed, for example, in Japanese Patent Publication No. 56-40259.

Although the above-mentioned technique of melting the ice clogging by resorting to the use of hot gas can certainly assure desired effects to some extent, it suffers from another problem that a lot of time is taken for clearing away the ice clogging because heat of the hot gas is transmitted to the inner wall surface of the refrigerating cylinder to thereby cause a cavity to be formed along the cylinder inner surface because of absence of the coolant vaporizing tube around the press head assembly. Besides, additional provision of the hot gas pipe involves complication in the structure, to another disadvantage.

As an approach tackling the problems mentioned above, there is proposed, for example, in Japanese Patent Publication No. 3-32716 a technique for melting away the ice clogging by supplying continuously raw water from a feed water system or circuit. This prior art method will be elucidated by reference to FIGS. 12 and 13 of the accompanying drawings.

Referring to FIG. 12, a coolant of high pressure discharged from a compressor 1 is condensed within a condenser 3 which is cooled by a fan 2 and vaporized within a vaporizing tube 4 to thereby cool a refrigerating cylinder 5 by depriving of heat. An auger 6 mounted within the refrigerating cylinder 5 is rotatively driven by a geared motor 8 through a reduction gear 7 to thereby scrape off ice formed on the inner wall surface of the refrigerating cylinder 5. The ice chips thus formed are fed into a discharge cylinder 10 through a compressing passage formed in a press head assembly 9. For supplying raw water to the refrigerating cylinder 5, water is tapped from a water service via a pipe 12 having a feed valve 11 installed therein to be first supplied to a feed water tank 13, from which water is fed into the refrigerating cylinder 5 via a feed pipe 14. On the other hand, water is drained through a drain pipe 16 equipped with a drain valve 15. Control of water level within the refrigerating cylinder 5 is effected by controlling correspondingly the feed valve 11 by means of a float switch 17 disposed within the feed water tank 16.

The auger-type ice making machine of the structure described above is provided with an electric circuit shown in FIG. 13. In operation, when a main switch S is closed, the feed valve 11 is opened under the actions of the float switch 17 and relays R1 and R2, whereby water is supplied to the feed water tank 13 until the water level therein attains a predetermined height. Upon completion of the feed water supply, ice making operation is started by supplying electric energy to the compressor 1, the motor-driven fan unit 2 and the geared motor 8 so long as the ice making machine can operate normally. When jamming of ice takes place, excessive cooling is detected by a thermostat 18 or alternatively overload of the geared motor 8 is detected by an overcurrent detector 19. Then, the drain valve 15 is opened, whereby water resident within the refrigerating cylinder 5 is discharged or drained. As a result of this, the water level within the feed water tank 13 is lowered to cause the float switch 17 to be actuated. Thus, water is fed into the water tank 13. In this way, feeding and draining of water are performed simultaneously, whereby raw water is caused to flow into the refrigerating cylinder and flow out therefrom. Under the effect of sensible heat of the feed water, ice is molten, whereby the jamming or clogging is cleared away. Before a time preset in a timer TM has lapsed, the ice making operation is not restarted even when the thermostat is restored to the normal state. Thus, the feed water continues to flow through the refrigerating cylinder in vain.

The continuous water feeding and draining mentioned above present a problem remaining to be solved. Namely, the ice jamming or clogging generally takes place initially in a tom end portion of the refrigerating cylinder and propagates downwardly. By contrast, the feed pipe and the drain pipe are communicated to the refrigerating cylinder at a lower portion thereof. Consequently, water as fed tends to flow primarily through a bottom end portion of the refrigerating cylinder. Thus, the ice melting action of feed water can become effective only with a considerable time lag. As a result, a lot of time is required for melting away the ice clogging. Besides, a remarkably large amount of fresh water will be consumed. Such unfavorable phenomenon becomes significant in the winter season where temperature of feed water is low.

When the time preset in the timer TM has lapsed with the thermostat 18 being restored to the normal state as the ice melting process proceeds normally, the ice making operation is automatically restarted. Thus, maintenance for operation of the auger-type ice making machine can be facilitated. However, unless the fundamental measures for removing the causes of the ice jamming phenomenon are taken, the overload/overcurrent event of the geared motor due to the ice jamming will occur repetitively, incurring possibly more serious failure or accident.

SUMMARY OF THE INVENTION

In the light of the state of the art described above, it is an object of the present invention to provide an auger-type ice making machine which is imparted with capability of speedily clearing away the ice jamming or clogging while preventing repetitive occurrence of such phenomenon, with a view to solving the problems which the prior art ice making machine suffers.

In view of the above and other objects which will become more apparent as description proceeds, there is provided according to a general aspect of the present invention an auger-type ice making machine which is comprised of a refrigerating cylinder, an auger disposed rotatably within the refrigerating cylinder and provided with a spiral blade, a refrigerating system including a coolant vaporizing tube wound around an outer periphery of the refrigerating cylinder, a driving motor for driving rotatively the auger, a water supply system for feeding raw water into the refrigerating cylinder, an electric heater mounted around an outlet end portion of the refrigerating cylinder into and through which ice is transported under the effect of the rotation of the auger, and a control circuit for electrically energizing the electric heater upon detection of an overcurrent flow in the driving motor.

With the structure of the auger-type ice making machine described above, when delivery of ice becomes stagnated due to occurrence of ice jamming or clogging in a top end portion of the refrigerating cylinder in the course of normal ice making operation, large resistance acts on the auger, which results in that an overcurrent flows through the driving motor. Upon detection of this overcurrent by the control circuit, the electric heater is energized, whereby ice resident within the refrigerating cylinder at a top end portion thereof is molten. In this manner, the ice jamming or clogging phenomenon can rapidly be cleared away.

DESCRIPTION OF THE PREFERRED EMBODIMENTS

In the following, the present invention will be described in detail in conjunction with preferred embodiments thereof by reference to the drawings, in which identical reference numbers are used for denoting equivalent elements.

Embodiment 1

Figure 1:
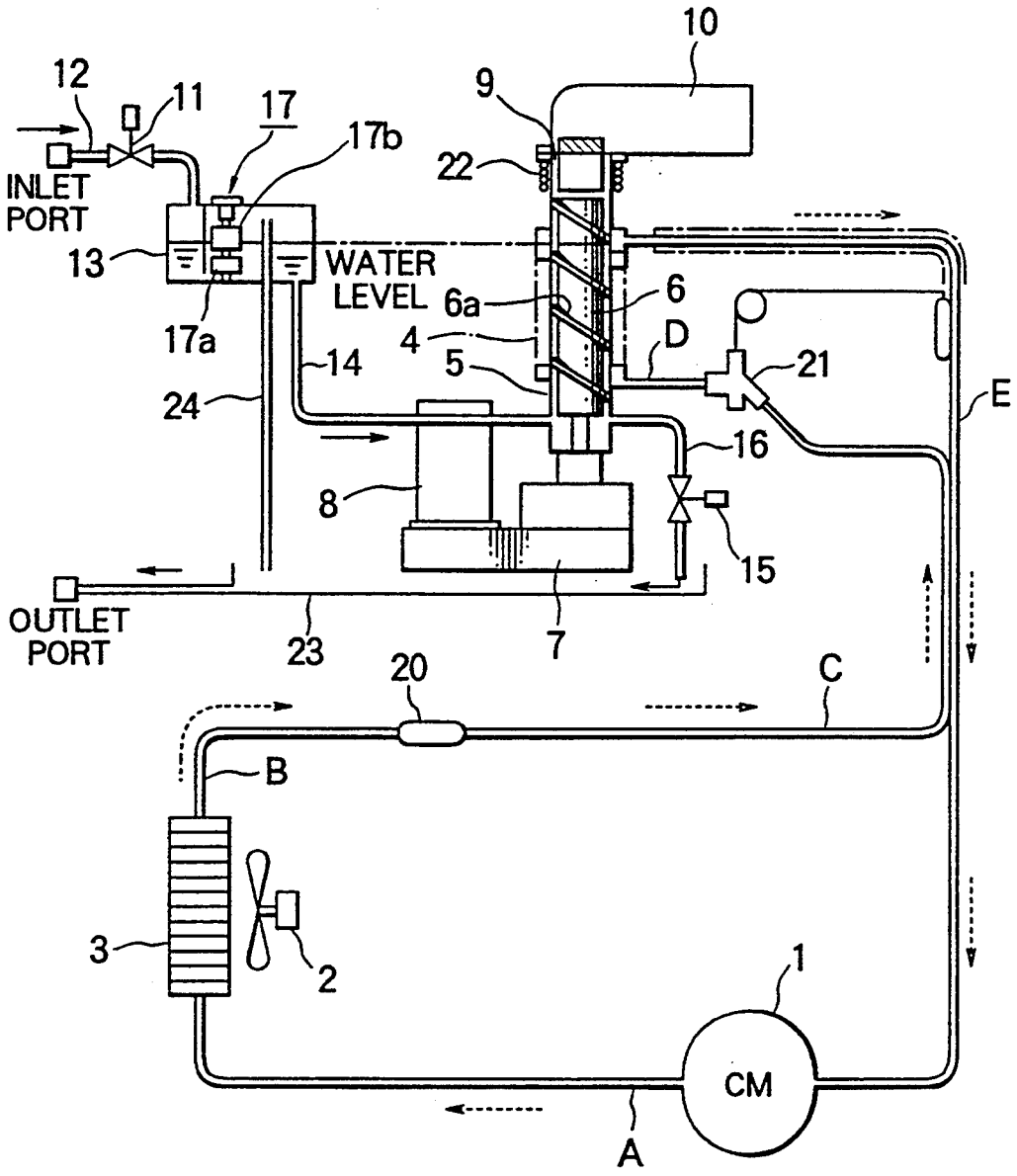
FIG. 1 is a diagram showing schematically a general arrangement or structure of an auger-type ice making machine according to a first embodiment of the invention.

FIG. 1 is a diagram showing schematically a general arrangement of an auger-type ice making machine inclusive of a refrigerating circuit system and a water flow circuit system according to a first embodiment of the invention. Describing in general basic structure and functions of the auger-type ice making machine according to the instant embodiment by reference to FIG. 1, a refrigerating circuit system is constituted by a coolant compressor 1, a condenser 3, a dryer 20, an expansion valve 21 and a vaporizing tube 4 which are interconnected by way of pipes A, B, C, D and E in series in this order, wherein a coolant flows in the direction as indicated by broken-line arrows. The condenser 3 is forcibly cooled by a motor-driven fan unit 2. During the ice-making operation, the coolant is first compressed by the coolant compressor 1 to a high-pressure/high-temperature state, and then cooled down by the condenser 3 to be thereby condensed. Subsequently, the coolant undergoes expansion in the expansion valve 21, which is followed by vaporization within the vaporizing tube 4.which is wound around a refrigerating cylinder 5 in intimate contact with the outer peripheral surface thereof and is surrounded or covered with heat insulating material (not shown).

Disposed rotatably within the refrigerating cylinder 5 is an auger 6 which has a bottom end operatively connected to a geared motor (driving motor) 8 through the medium of a reduction gear 7. The auger 6 thus driven rotatively by the geared motor 8 has an outer peripheral surface provided with a spiral blade 6a and is rotatably supported by a press head assembly 9 mounted at a top end of the refrigerating cylinder 5. An ice compression passage is formed in the press head assembly 9 and leads to a discharge cylinder 10. Thus, sherbet-like ice chips scraped off and fed by the spiral blade *6a* of the auger 6 are compressed and dewatered within the compression passage to be transformed into flake-like pieces and fed to the discharge cylinder 10. An electric heater wire 22 is wound around the outer periphery of the press head assembly 9.

A feed water tank 13 communicated to the refrigerating cylinder 5 at a lower end portion thereof via a feed pipe 14 is connected to a tap 12 of water service equipment via a feed water valve 13. Disposed interiorly of the feed water tank 13 is a float switch assembly 17 which includes a lower float switch 17*a* for detecting a predetermined lower level of water within the feed water tank 13 and an upper float switch 17*b* for detecting a predetermined upper water level and which serves for controlling the water levels within the feed water tank 13 and the refrigerating cylinder 5, respectively. Parenthetically, it is noted that the feed water tank 13 is equipped with an overflow pipe 24 having a distal end opened into a drain pan 23, whereby occurrence of an excessively high water level in the feed water tank 13 is positively suppressed. Further provided in communication to the refrigerating cylinder 5 at a lower end portion thereof is a drain pipe 16 which is provided with a drain valve 15 for allowing rawwater to be discharged from the refrigerating cylinder 5 in the state where the ice making operation is shut down, as described hereinafter.

Figure 2:
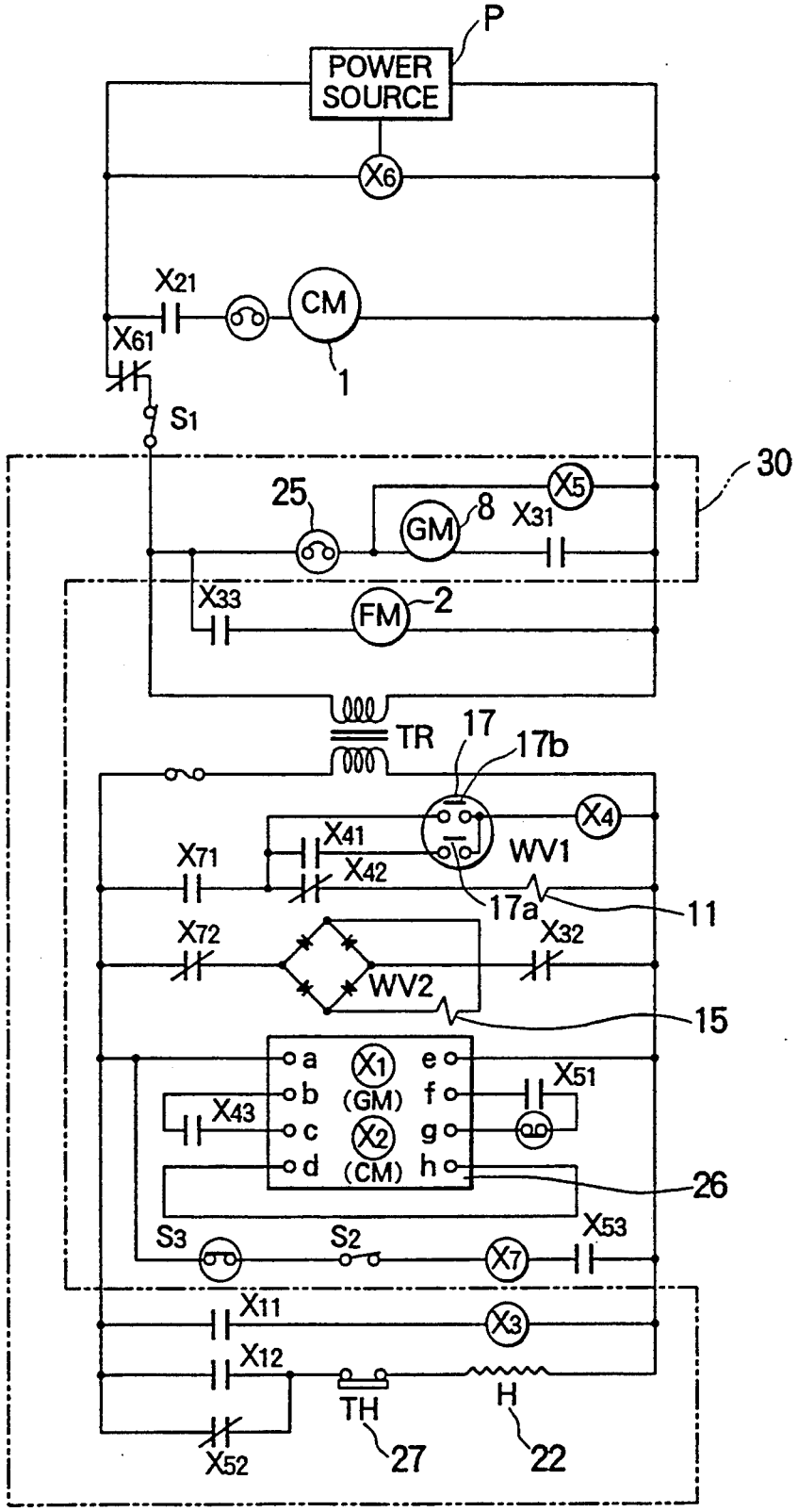
FIG. 2 is a circuit diagram showing an electric circuit for operating the auger-type ice making machine according to the first embodiment of the invention.

FIG. 2 shows an electric circuit for operating the ice making machine according to the instant embodiment of the invention. The coolant compressor 1, the motor-driven fan unit 2 and the geared motor 8 which require relatively large currents for operations thereof are connected to a power source P in parallel with one another, wherein a protector 25 is connected in series to the geared motor 8. The float switch mechanism 17, a timer board 26, the feed water valve 11 and the drain valve 15 which are primarily in charge of control of the water flow are connected in parallel with each other and coupled to a driver circuitry for the coolant compressor 1, etc. through interposition of a transformer TR. A temperature-responsive device such as an overheat protection thermostat 27 is connected in series to the electric heater 22 which is connected in parallel with the float switch mechanism 17 and others. The protector 25 and the thermostat 27 cooperate with a relay $X_5$ and a normally open contact $X_{52}$ thereof and others to constitute a control circuit 30 for electrically energizing the electric heater 22 in response to detection of an overcurrent flow in the geared motor 8.

At this juncture, it should be mentioned that the auger-type ice making machine is equipped with an ice storage box or chamber (not shown) in which an ice storage sensor switch $S_3$ is provided. This switch $S_3$ is designed to be opened when the ice storage chamber is filled with ice and, if otherwise, closed.

Now, description will turn to operation of the auger-type ice making machine according to the instant embodiment of the invention. When a main switch $S_1$ is closed, the relay $X_5$ is electrically energized, resulting in that a relay contact $X_{53}$ is closed. When the ice storage sensor switch $S_3$ installed within the ice storage chamber is closed at this time point, a relay $X_7$ is energized, whereby a relay contact $X_{71}$ thereof is closed. As a result, the feed valve 11 is opened unless the feed water tank 13 is full of water, whereby water supply to the feed water tank 13 is started. When the water level within the feed water tank 13 rises up to a level where the upper float switch 17*b* of the float switch mechanism 17 is actuated, a relay $X_4$ is electrically energized to cause a relay contact $X_{42}$ to be opened, whereby the feed water valve 11 is closed. The energization of the relay $X_4$ also causes a relay contact $X_{43}$ and hence a path between terminals b and c of the timer board 26 to be closed, which in turn results in-that the relay $X_1$ is first electrically energized, being then followed by energization of the relay $X_2$. The energization of the relay $X_1$ is accompanied with closing of a relay contact $X_{12}$, whereby the electric heater 22 is supplied with an electric power, while closing of a relay contact $X_{11}$ of the relay $X_1$ brings about energization of a relay $X_3$ with a relay contact $X_{31}$ thereof being closed. Thus, power supply to the geared motor 8 is enabled. Subsequently, when the relay $X_2$ is energized, the relay contact $X_{21}$ is closed to thereby allow an electric current to flow through the coolant compressor 1, whereupon the ice making operation is started.

As mentioned previously, when abnormality of water supply due to malfunction of the ice storage sensor switch $S_3$ or the float switch mechanism 17 is left intact during the ice making operation, there takes place ice jamming phenomenon and/or abnormal freezing or clogging within the refrigerating cylinder 5. In that case, load imposed onto the auger 6 increases, which will of course involve a corresponding increase in the load applied to the geared motor 8. When the motor load exceeds a stalling torque thereof, the geared motor 8 is locked, incurring an excessive large current flowing therethrough. In response to this overcurrent, the protector 25 is opened to deenergize the relay $X_5$ which results in the opening of the relay contact $X_{51}$ and hence deenergization of the relays $X_1$ and $X_2$ of the timer board 26. Thus, the relay contacts $X_{11}$ and $X_{21}$ are opened with the relay $X_3$ being deenergized for allowing the associated relay contacts $X_{31}$ and $X_{33}$ to be opened. Thus, operations of the coolant compressor 1, the motor-driven fan unit 2 and the geared motor 8 are stopped, whereby the ice making operation is shut down.

Upon deenergization of the relay $X_5$ mentioned above, the associated relay contact $X_{53}$ is opened to deenergize the relay $X_7$, as a result of which relay contacts $X_{71}$ and $X_{72}$ are opened and closed, respectively. As a result of this, the feed water valve 11 is closed while the drain valve 15 is opened, whereby water in the water circuit is discharged or drained. Further, deenergization of the relay $X_5$ is accompanied with closing of the relay contact $X_{52}$, which results in that the electric heater 22 is electrically energized via the thermostat 27. Consequently, the top end portion of the refrigerating cylinder 5 is heated to melt jamming or clogging ice as well as stagnant ice resident within the refrigerating cylinder 5. Upon melting of obstructive ice, the temperature of the top end portion of the refrigerating cylinder 5 will rise up to a predetermined level to which the thermostat 27 responds to interrupt the power supply to the electric heater 22.

When the power supply to the electric heater 22 is interrupted in this way, the auger 6 may be operated by actuating the geared motor 8. To this end, the cause which brought about the aforementioned operation of the protector 25 is removed through an inspection procedure to thereby cope with malfunctions, if any, by resorting to appropriate measures. Thereafter, the protector 25 is manually reset. Thus, the relay $X_5$ is electrically energized, whereupon the ice making operation can be restored.

Parenthetically, a relay $X_6$ connected in parallel to the power source P and a normally closed contact $X_{61}$ thereof shown in FIG. 2 constitutes a protection circuit for protecting the electric circuit of FIG. 2 when it is connected to a power source of higher rating than that of the electric circuit under consideration. By way of example, the electric circuit shown in FIG. 2 may be so designed as to be connected to a power source P rated 115/120 volts. Accordingly, when the electric circuit is connected to the power source P of this rating, the relay X6 is not energized with the relay contact $X_{61}$ remaining in the closed state, whereby power supply to the electric circuit is effected through the relay contact $X_{61}$. On the other hand, when the electric circuit of concern is connected to a power source rated, for example, in a range of 208 to 240 volts, the relay $X_6$ is energized with the relay contact $X_{61}$ being opened, whereby power supply from this source is interrupted. Thus, the electric circuit is positively protected against injury or damage.

Embodiment 2

Figure 3:
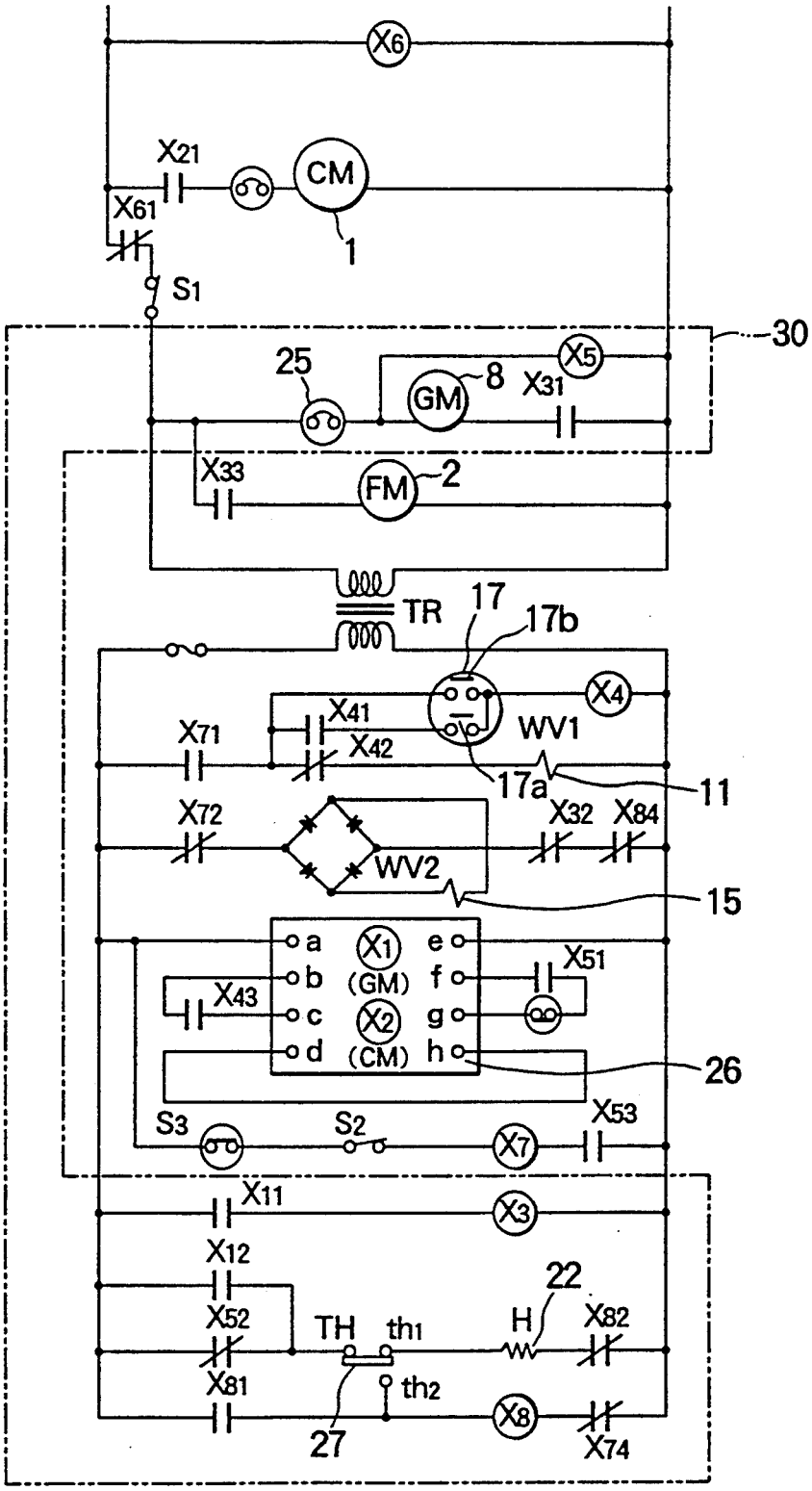
FIG. 3 is a circuit diagram showing another configuration of the electric circuit for operating the auger-type ice making machine according to a second embodiment of the invention.

FIG. 3 shows another configuration of the electric circuit according to a second embodiment of the invention which can be equally employed for operating the auger-type ice making machine shown in FIG. 1. The electric circuit shown in FIG. 3 differs from the one shown in FIG. 2 in that the thermostat 27 is provided with a normally closed contact $th_1$ and a normally opened contact $th_2$ and that a relay contact $X_{74}$ for the relay $X_7$ as well as a relay $X_8$ and relay contacts $X_{81}$, $X_{82}$ and $X_{84}$ are additionally provided. It should first be mentioned that the operation of the electric circuit according to the instant embodiment is substantially identical with that of the first embodiment so long as the ice making operation as well as operations required for starting the electric energization of the electric heater 22 via the thermostat 27 in succession to the stoppage of the ice making operation due to the ice jamming or the like abnormal event are concerned. Difference from the first embodiment is seen in that when the temperature of the top end portion of the refrigerating cylinder 5 rises up to a predetermined value due to heat generation of the electric heater 22, the normally closed contact $th_1$ of the thermostat 27 is opened with the normally opened contact $th_2$ being closed. Consequently, the relay $X_8$ is electrically energized via the normally opened contact $th_2$ as well as the normally closed relay contacts $X_{52}$ and $X_{74}$, whereby the relay contact $X_{81}$ is closed to form a self-hold circuit for the relay $X_8$. Thus, even when the temperature of the refrigerating cylinder 5 becomes lower subsequently, the electric heater 22 is prevented from being again electrically energized. Thus, the electric heater 22 is not actuated, which in turn means that the drain valve 15 remains in the inoperative state.

Restarting of the ice making operation is enabled by manually resetting the protector 25 after the cause for the operation of the protector 25 is determined by inspection and after appropriate measures for coping with the malfunction have been taken. When the protector 25 is reset, the relay $X_5$ is electrically energized to close the relay contact $X_{53}$. At the same time, the relay $X_7$ is energized to open the relay contact $X_{74}$, whereby the self-hold circuit for the relay $X_8$ is cleared. In this way, the normal ice making operation is restarted.

Embodiment 3

Figure 4:
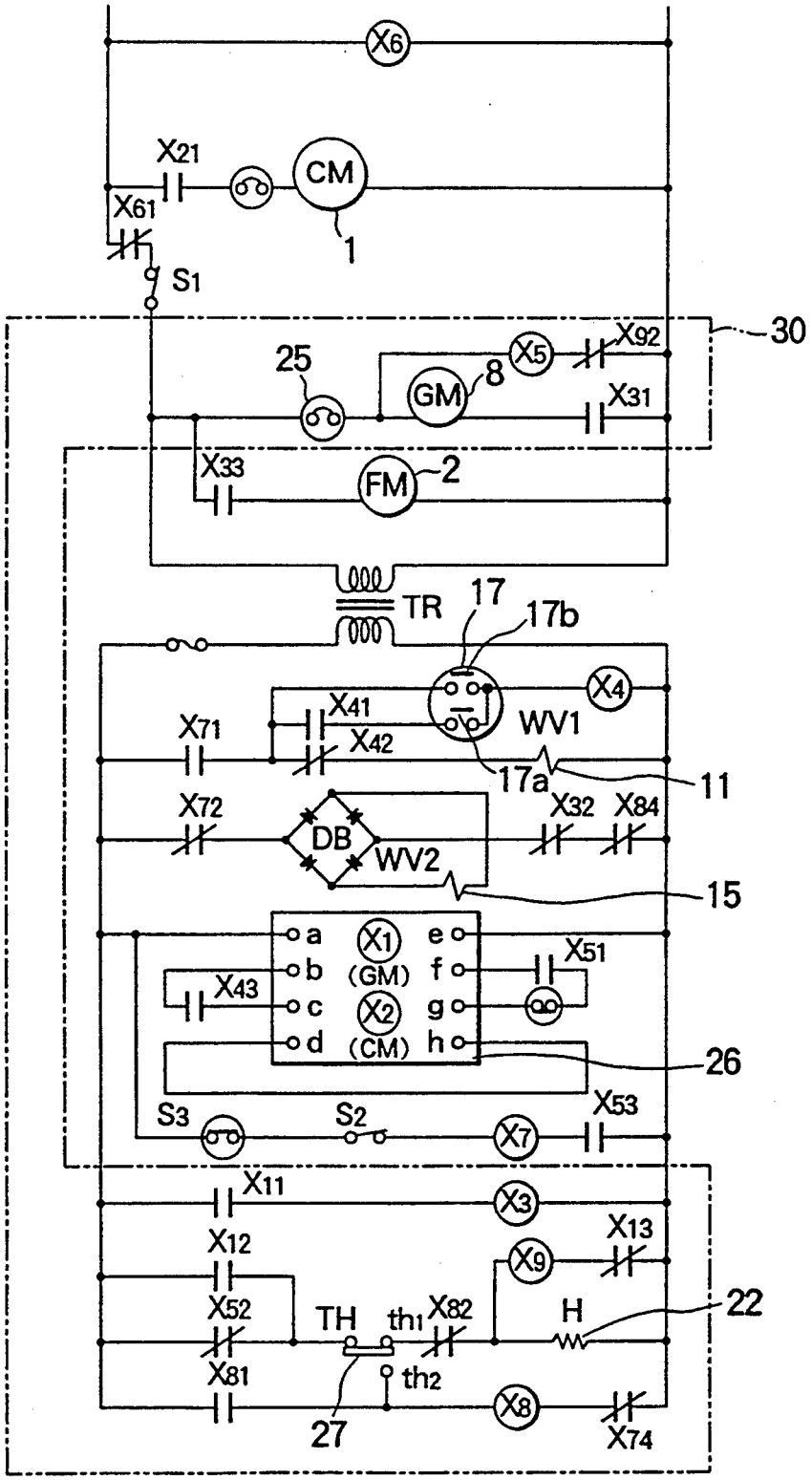
FIG. 4 is a circuit diagram showing yet another configuration of the electric circuit according to a third embodiment of the invention.

FIG. 4 shows yet another configuration of the electric circuit according to a third embodiment of the invention which can be employed for effectuating and controlling the operation of the auger-type ice making machine shown in FIG. 1. The electric circuit shown in FIG. 4 differs from the one shown in FIG. 3 in that a relay $X_9$ is additionally provided in parallel connection to the electric heater 22, a normally closed contact $X_{92}$ of the relay $X_9$ is connected in series to the relay $X_5$ and that the normally closed contact $X_{13}$ of the relay $X_1$ is connected in series to the relay $X_9$.

Figure 5:
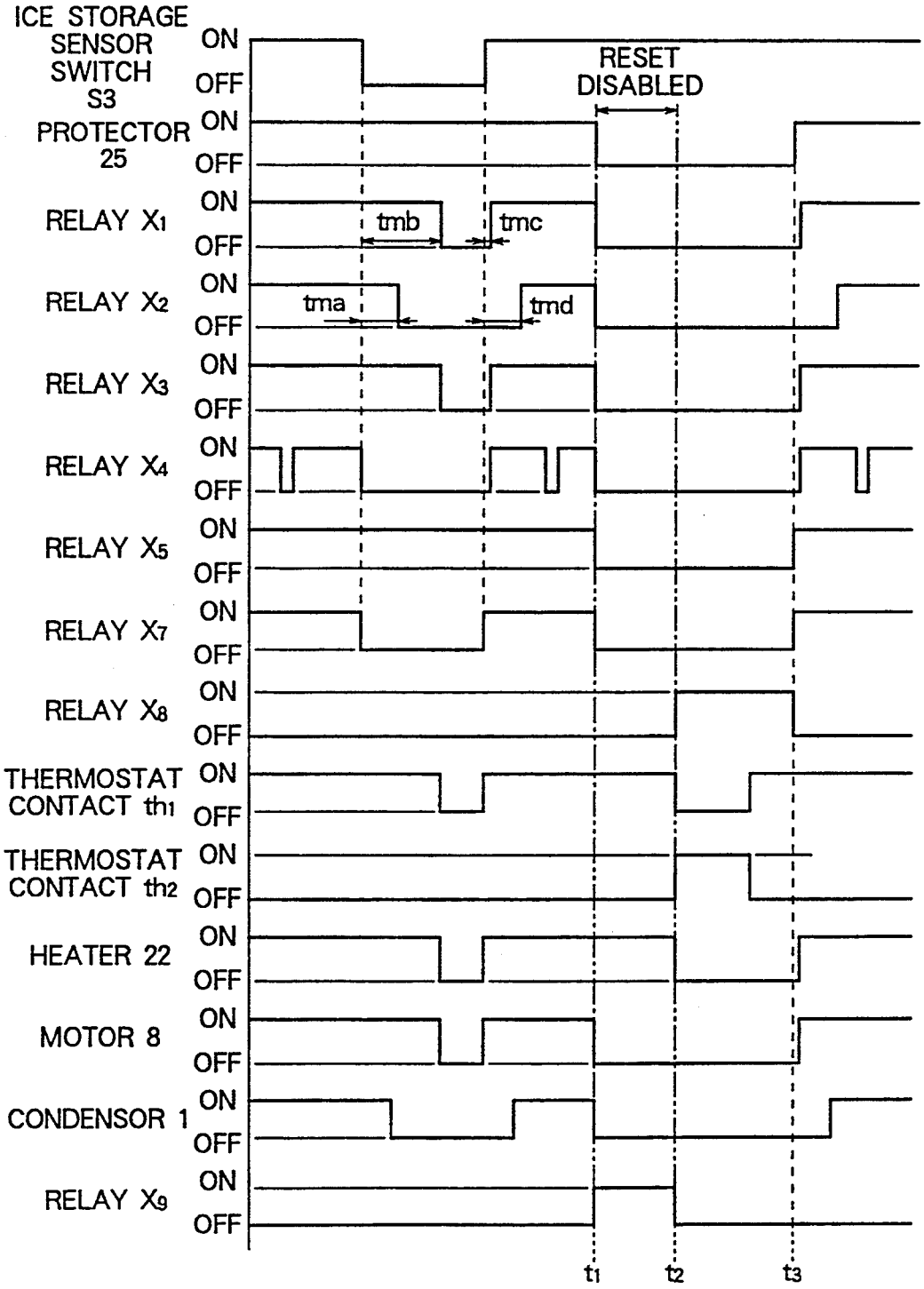
FIG. 5 is a timing chart for illustrating operations of the electric circuit shown in FIG. 4.

FIG. 5 shows a timing chart for illustrating operations of the auger-type ice making machine according to the third embodiment of the invention. When the ice making operation is stopped in response to the opening of the protector 25 at a time point t1, the relays $X_1$, $X_5$ and $X_8$ are deenergized, whereby the relay contacts $X_{13}$, $X_{52}$ and $X_{82}$ are closed. Consequently, so long as the electric heater 22 is electrically energized with the normally closed contact $th_1$ of the thermostat 27 being closed, the relay $X_9$ is electrically energized with the relay contact $X_{92}$ thereof being opened. Accordingly, even if the protector 25 is reset during operation of the electric heater 22, the relay $X_5$ is not electrically energized, which in turn means that the ice making operation is not started. When the thermostat 27 detects the temperature rise to a predetermined level to thereby open the normally closed contact $th_1$ while closing the normally opened contact $th_2$ at a time point t2, the power supply to the electric heater 22 as well as electric energization of the relay $X_9$ is terminated, whereupon a selfhold circuit for the relay $X_8$ is formed, as described hereinbefore in conjunction with the second embodiment of the invention by reference to FIG. 3. After remedying the malfunctions such as mentioned previously, the protector 25 is manually reset to thereby restore the ice making operation. In this manner, according to the teaching of the invention incarnated in the instant embodiment, restart of the geared motor 8 is prevented so long as the electric heater 22 is electrically energized.

Incidentally, in FIG. 5, reference symbols tma, tmb, tmc and tmd designate time points set in a timer for regulating operations of the relays $X_1$ and $X_2$ incorporated in the timer board 26.

Figure 6:
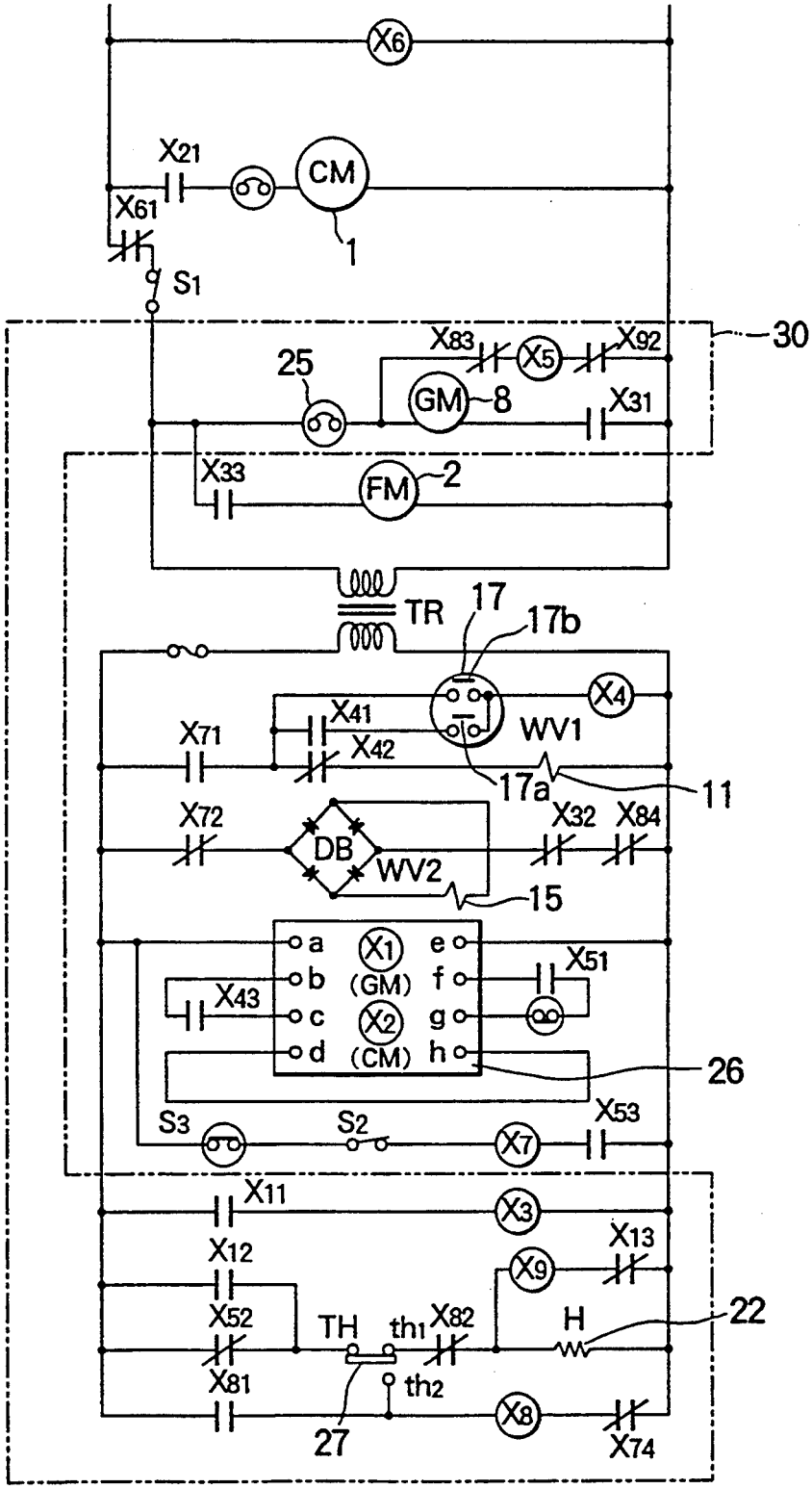
FIG. 6 is a circuit diagram showing a modification of the electric circuit shown in FIG. 4.

Further, it should be noted that by connecting the normally closed contact $X_{83}$ of the relay $X_8$ in series to the relay contact $X_{92}$ of the relay $X_5$, as shown in FIG. 6, the self-hold circuit for the relay $X_8$ is not cleared unless the power supply from the power source is interrupted, whereby a further enhanced protection function can be realized.

Embodiment 4

Figure 7:
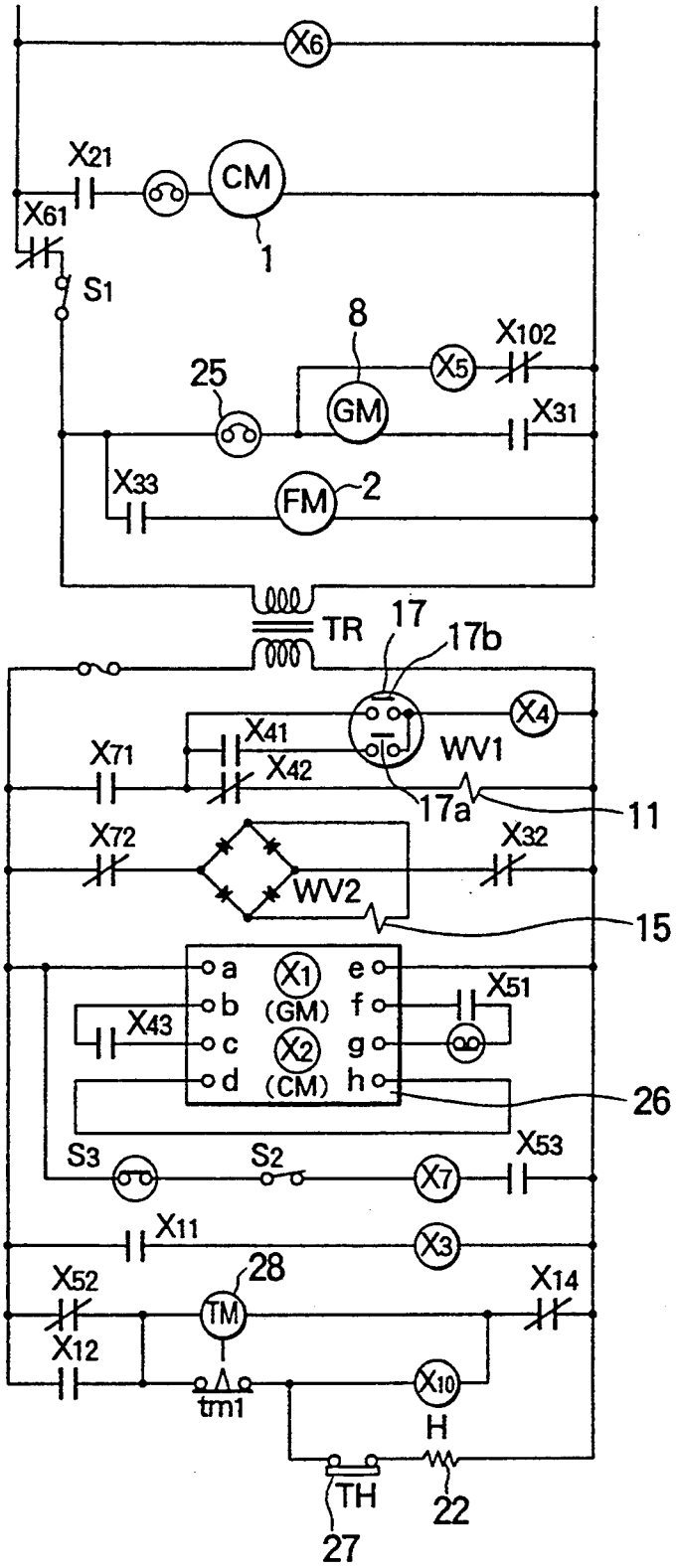
FIG. 7 is a circuit diagram showing a still another configuration of the electric circuit according to a fourth embodiment of the invention.
Figure 8:
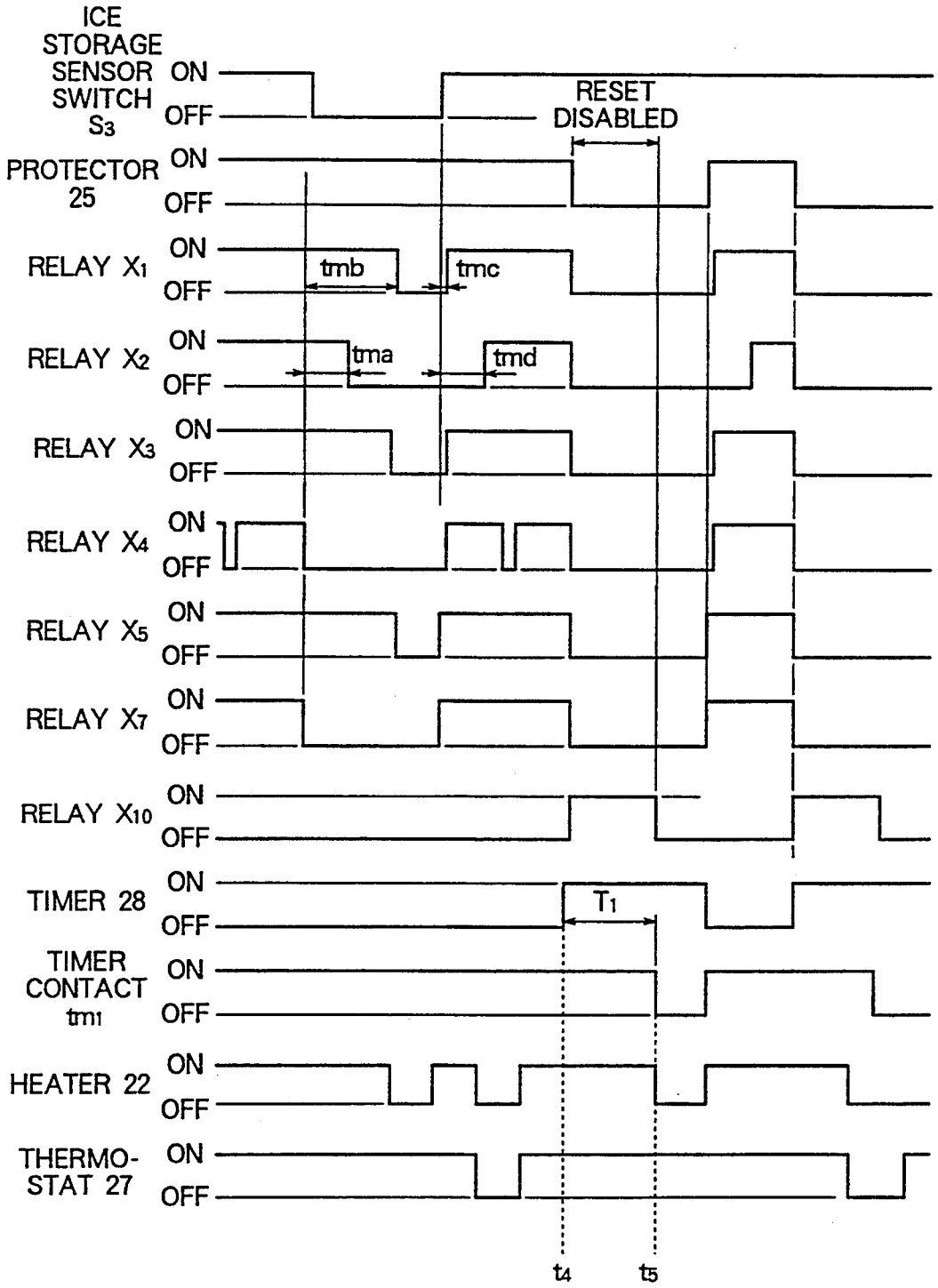
FIG. 8 is a timing chart for illustrating operation of the electric circuit shown in FIG. 7.

FIG. 7 shows a still another configuration of the electric circuit according to a fourth embodiment of the invention which is designed for effectuating and controlling operation of the auger-type ice making machine shown in FIG. 1. The electric circuit shown in FIG. 7 differs from the one shown in FIG. 2 in that a timer 28 and a normally closed relay contact $X_{14}$ are connected in series to the normally closed relay contact $X_{52}$ of the relay $X_5$, a normally closed contact $tm_1$ of the timer 28 is connected between the relay contact $X_{52}$ and the thermostat 27, and that a relay $X_{10}$ is connected between the timer contact $tm_1$ and the normally closed relay contact $X_{14}$ with a normally closed relay contact $X_{102}$ of the relay $X_{10}$ being connected in series to the relay $X_5$. FIG. 8 is a timing chart for illustrating operation of the auger-type ice making machine provided with the electric circuit according to the instant embodiment of the invention.

When the ice making operation is stopped with the protector 25 being opened at a time point t4, the relay $X_5$ is deenergized, whereby the relay contact $X_{53}$ is opened to deenergize the relay $X_7$, which results in that the relay contacts $X_{71}$ and $X_{72}$ are opened and closed, respectively. As a consequence, the feed water valve 11 is closed while the drain valve 15 is opened, whereby water within the water circuit or system is drained. Besides, the relay contact $X_{52}$ is closed due to deenergization of the relay $X_5$. Thus, the electric heater 22 is supplied with electric energy via the timer contact $tm_1$ and the thermostat 27. Additionally, electric power is supplied to the timer 28 as well. Thus, the timer 28 starts time count operation. Additionally, the relay $X_{10}$ is also electrically energized, whereby the relay contact $X_{102}$ thereof is opened. This state continues to a time point t5 at which the timer contact $tim_1$ is opened after lapse of the time $T_1$ preset at the timer 28. For this reason, manual resetting of the protector 25 during a period from a time point t4 to t5 can not restore the ice making operation. Parenthetically, the time or period $T_1$ set in the timer 28 may previously be determined by taking into account the time required for the auger 6 to rotate without encountering any obstacle after ice resident within the refrigerating cylinder 5 is molten under heating by the electric heater 22.

At the end or termination of electric energization of the electric heater 22, the auger 6 may be driven by actuating the geared motor 8. In that case, the cause which triggered the operation of the protector 25 is determined by inspection, and measures for remedying the malfunctions, if any, are taken, whereupon the protector 25 is manually reset. Then the relay $X_5$ is electrically energized. Thus, the ice making operation can be restored.

Embodiment 5

Figure 9:
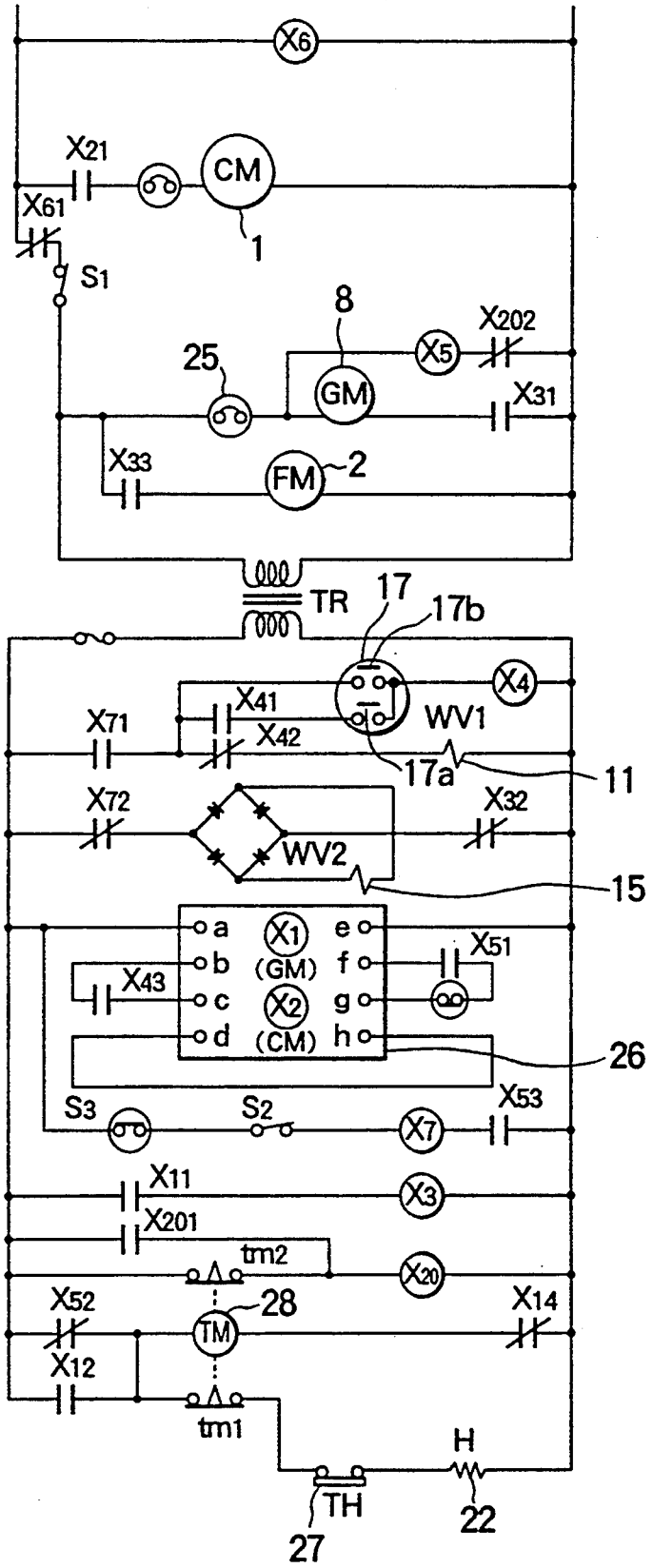
FIG. 9 is a circuit diagram showing a further configuration of the electric circuit according to a fifth embodiment of the invention.

FIG. 9 shows a further configuration of the electric circuit for operating the auger-type ice making machine according to a fifth embodiment of the invention. The electric circuit according to the instant embodiment differs from the electric circuit according to the fourth embodiment shown in FIG. 4 in that the timer 28 has a normally opened contact $tm_2$, a relay $X_{20}$ is connected in series to this contact $tm_2$ and that the relay $X_{10}$ provided in the electric circuit shown in FIG. 7 is spared. Additionally, a normally opened contact $X_{201}$ of a relay $X_{20}$ is connected in series to the relay $X_{20}$ with a normally closed contact $X_{202}$ thereof being connected in series to the relay $X_5$.

When the timer contact tim.: is opened upon lapse of a time $T_1$ preset in the timer 28, another timer contact $tm_2$ is closed. As a consequence, the relay $X_{20}$ is electrically energized to open the relay contact $X_{202}$. Besides, because the relay contact $X_{201}$ of the relay $X_{20}$ is closed, a self-hold circuit for the relay $X_{20}$ is formed such that the auger-type ice making machine can not be restarred even when the protector 25 is reset with the relay contact $X_{202}$ being opened unless the relay $X_{20}$ is deenergized.

Embodiment 6

Figure 10:
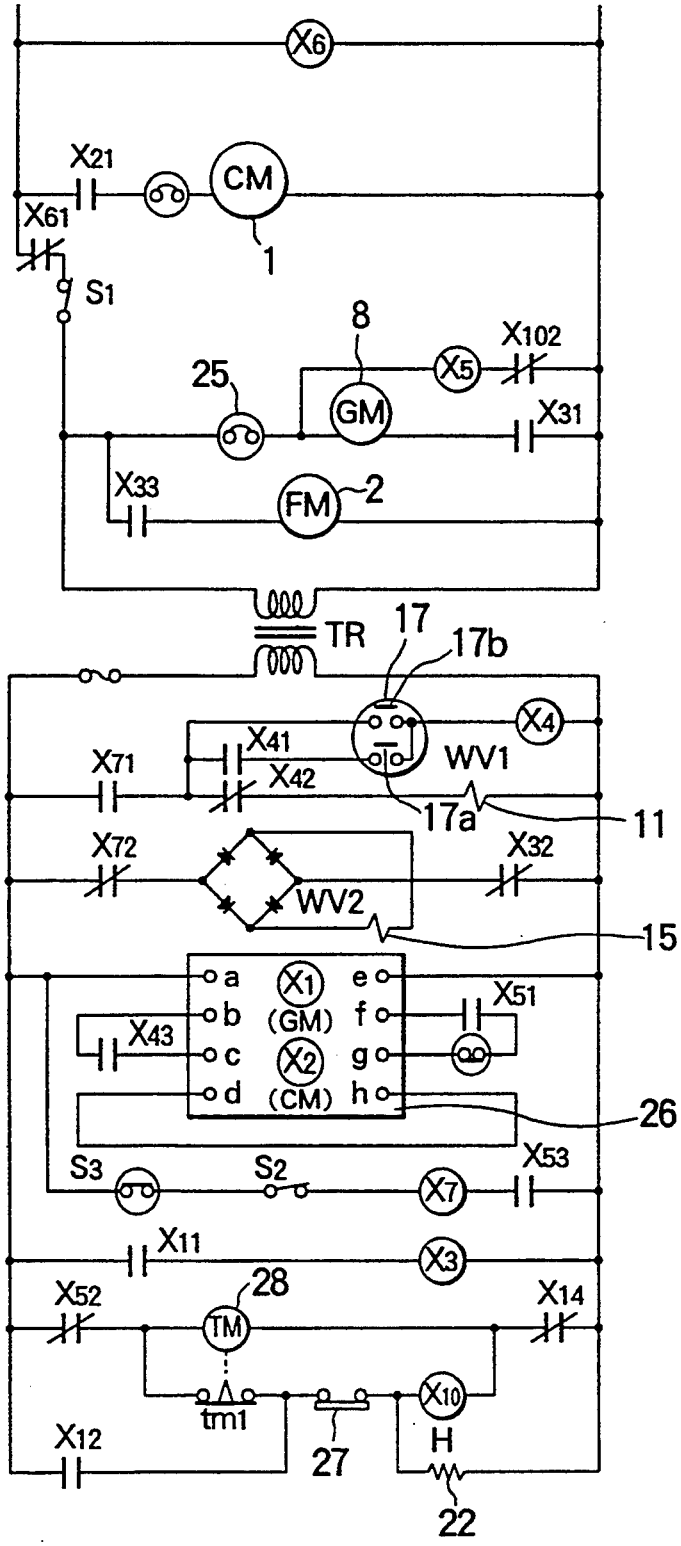
FIG. 10 is a circuit diagram showing an electric circuit according to a sixth embodiment of the invention.
Figure 11:
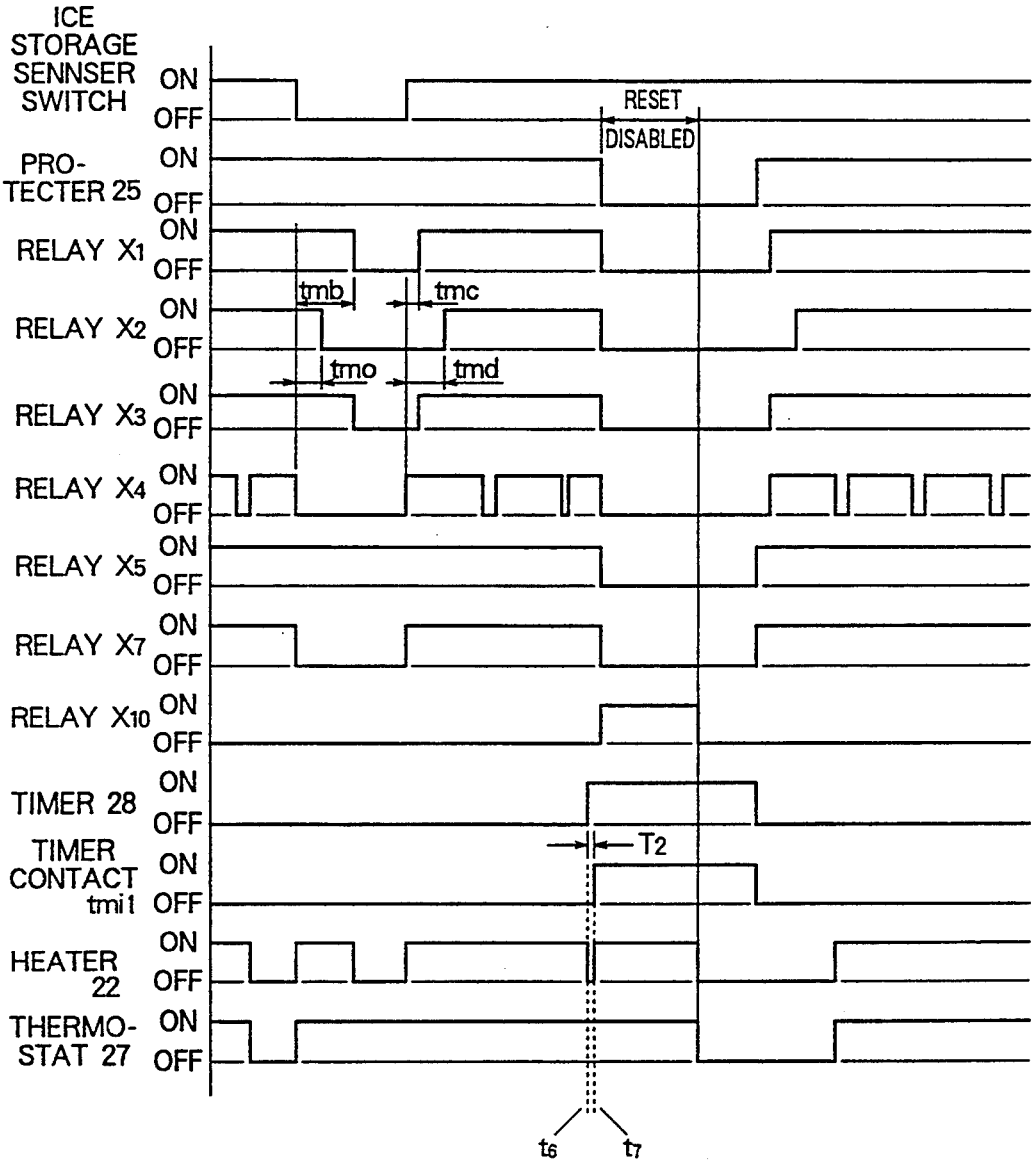
FIG. 11 is a timing chart for illustrating operations of the electric circuit shown in FIG. 10.
Figure 12:
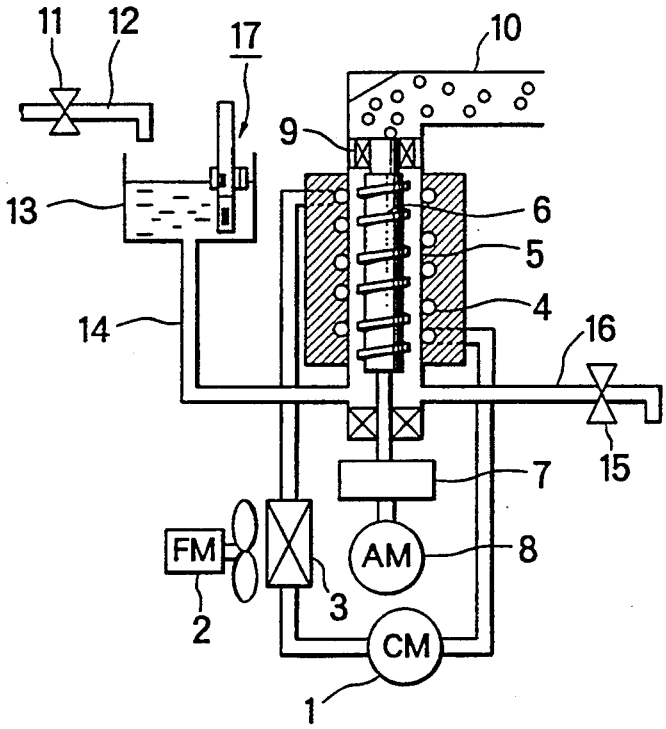
FIG. 12 PRIOR ART
FIG. 12 is a view showing schematically a general arrangement of the conventional auger-type ice making machine.
Figure 13:
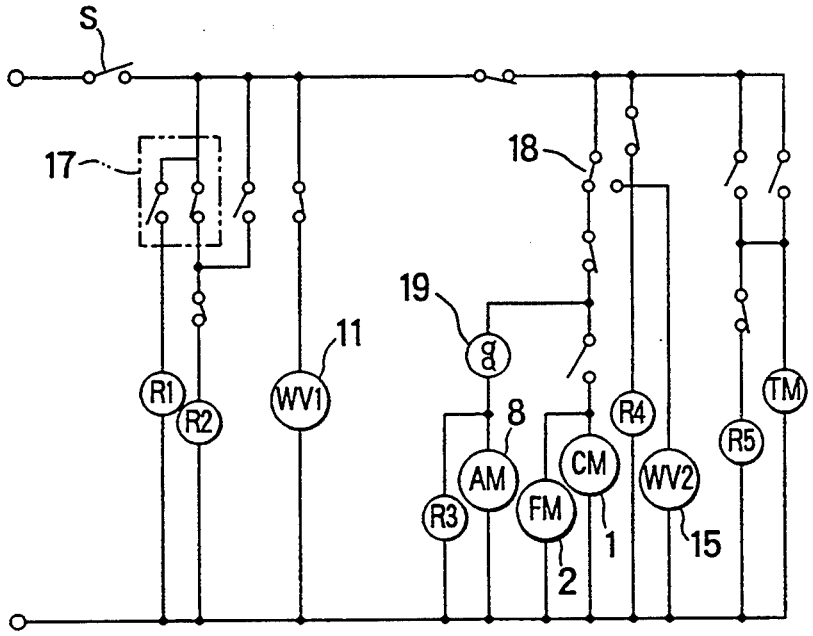
FIG. 13 PRIOR ART
FIG. 13 is a circuit diagram showing an electric circuit employed in the ice making machine shown in FIG. 12.

FIG. 10 shows an electric circuit for operating the auger-type ice making machine according to a sixth embodiment of the invention. The electric circuit according to the instant embodiment differs from the fourth embodiment shown in FIG. 7 in that the thermostat 27 is connected in series to the relay $X_{10}$ for ensuring a more reliable protecting function. FIG. 11 is a timing chart for illustrating operations of the auger-type ice making machine provided with the electric circuit according to the instant embodiment.

As pointed out previously, when jamming or abnormal freezing takes place within the refrigerating cylinder 5 for some default, the load imposed onto the auger 6 may increase to such a level where the load of the geared motor 8 exceeds the stalling torque, whereby the geared motor 8 is locked, giving rise to an excessive large current flow through the geared motor 8. In that case, the protector 25 is opened in response to the excessively large current at a time point t6 shown in FIG. 11 to thereby deenergize the relay $X_5$, which results in that the relay contact $X_{51}$ is opened, whereby the relays $X_1$ and $X_2$ of the timer board 26 are electrically deenergized. Consequently, the relay contacts $X_{11}$ and $X_{21}$ are opened with the relay $X_3$ being deenergized. Thus, the relay contacts $X_{31}$ and $X_{33}$ are opened, whereby operations of the coolant compressor 1, the motor-driven fan unit 2 and the condenser 3 are stopped. In other words, the ice making operation is shut down.

When the relay $X_5$ is deenergized, as mentioned above, the relay contact $X_{53}$ is opened to deenergize the relay $X_7$, whereby the relay contacts $X_{71}$ and $X_{72}$ are opened and closed, respectively. As a result, the feed water valve 11 is closed while the drain valve 15 is opened to allow water within the water circuitry to be drained. Additionally, deenergization of the relay $X_5$ closes the relay contact $X_{52}$ to thereby allow the timer 28 to start the time counting operation. At a time point t7 at which the preset time of about one second preset in the timer 28 has lapsed, the timer contact $tm_1$ is closed, whereby the electric heater 22 is supplied with electric energy via the timer contact $tm_1$ and the thermostat 27 to thereby heat the top end portion of the refrigerating cylinder 5. Thus, jamming or stagnate ice resident within the refrigerating cylinder 5 is molten.

On the other hand, when the timer contact $tm_1$ is closed, the relay $X_{10}$ is energized with the relay contact $X_{102}$ thereof being opened. In this state, ice within the refrigerating cylinder 5 is molten under the effect of heating by the electric heater 22. Thus, the temperature of the top end portion of the refrigerating cylinder 5 rises up to a level where the contact of the thermostat 27 is opened to deenergize the relay $X_{10}$. During this time span, the relay $X_5$ is not electrically energized even when the protector 25 is manually reset. Thus, the ice making operation is not restarted. To say in another way, the protection function can further be reinforced.

As will now be apparent from the foregoing description, in the auger-type ice making machine according to the present invention, occurrence of ice jamming or clogging in a top end portion of the refrigerating cylinder can be detected in terms of an overcurrent flow in the driving motor. Thus, upon detection of the overcurrent, the electric heater is energized to thereby melt or fuse clogging ice. In this way, the ice jamming phenomenon can speedily be cleared away through operation of high reliability without incurring any significant consumption of feed water in vain. Besides, because the protector for the driving motor must manually be reset for restarting the ice making operation, there is made available a sufficient time for inspection, repair or the like maintenance procedure to prevent repetitive occurrence of ice jamming or clogging phenomenon.

Besides, by adopting such arrangement that electrical energization of the electric heater is inhibited so long as the protector is reset even when the temperature sensing device such as the thermostat is restored to the normal state due to lowering of the ambient temperature after the power supply to the heater is once interrupted upon detection of the melting of ice by the thermostat, not only wasteful power consumption but also deterioration of the heater can positively be prevented.

Furthermore, by adopting the arrangement in which the driving motor is inhibited from being restarted even when the protector thereof is reset so long as the heater is being energized, it is possible to prevent the ice making operation from being started regardless whether or not the protector for the driving motor is reset, so far as the auger is in the locked state, whereby the driving motor for the auger can positively be protected against injury or damage.

What is claimed is:

1. An auger-type ice making machine, comprising:

a refrigerating cylinder;

an auger disposed rotatably within said refrigerating cylinder and provided with a spiral blade;

a refrigerating system including a coolant vaporizing tube wound around outer periphery of said refrigerating cylinder;

a driving motor for driving rotatively said auger;

a water supply system for feeding raw water into said refrigerating cylinder;

electric heater means mounted around an outlet end portion of said refrigerating cylinder into and through which ice is transported under the effect of the rotation of said auger; and a control circuit for electrically energizing said electric heater means upon detection of an overcurrent flow in said driving motor.

2. An auger-type ice making machine according to claim 1 wherein said control circuit includes:

a protector connected in series between a power source and said driving motor and adapted to be opened upon occurrence of said overcurrent flow;

detecting means for detecting opening of said protector;

stop means for stopping operations of said driving motor and said refrigerating system in response to detection of opening of said protector by said detecting means; and electrically energizing means for electrically energizing said electric heater means upon detection of opening of said protector by said detecting means.

3. An auger-type ice making machine according to claim 2 wherein said detecting means includes first relay means connected in parallel to said driving motor and adapted to be electrically energized when said protector is closed while deenergized upon opening of said protector.

4. An auger-type ice making machine according to claim 3 wherein said electrically energizing means includes:

a thermostat connected in series to said electric heater means and adapted to be closed when temperature of said outlet end portion of said refrigerating cylinder becomes lower than a preset level while being opened unless said temperature is lower than said preset level; and second relay means for establishing electrical connection between said electric heater means and said thermostat and said power source upon deenergization of said first relay means.

5. An auger-type ice making machine according to claim 4 wherein said control circuit includes a re-energization inhibit circuit for preventing said electric heater means from being electrically energized by said electrically energizing means when said thermostat is closed again after having been once opened for interrupting the electrical energization of said electric heater means.

6. An auger-type ice making machine according to claim 5 wherein said re-energization inhibit means includes third relay means adapted to form a self-hold circuit in response to opening of said thermostat when opening of said protector is detected by said detecting means while interrupting electrical connection between said electric heater means and said power source.

7. An auger-type ice making machine according to claim 6 wherein said third relay means interrupts electrical connection between said first relay means and said power source when said self-hold circuit is formed.

8. An auger-type ice making machine according to claim 4 wherein said control circuit includes a restart inhibit circuitry for preventing said driving motor from being restarted so long as said electric heater means is electrically energized by said electrically energizing means.

9. An auger-type ice making machine according to claim 8 wherein said restart inhibit circuitry includes fourth relay means for interrupting electrical connection between said first relay means and said power source when said electric heater means is electrically energized.

10. An auger-type ice making machine according to claim 3 wherein said electrically energizing means includes:

a thermostat connected in series to said electric heater means and closed when temperature of said outlet end portion of said refrigerating cylinder becomes lower than a preset level while being opened unless said temperature is lower than said preset level; and a timer for establishing electrical connection between said electric heater means and thermostat and said power source for a predetermined time when said first relay means is deenergized.

11. An auger-type ice making machine according to claim 10 wherein said control circuit includes a restart inhibit circuitry for preventing said driving motor from being restated so long as said electric heater means is electrically energized by said electrically energizing means.

12. An auger-type ice making machine according to claim 11 wherein said restart inhibit circuitry includes fourth relay means for interrupting electrical connection between said first relay means and said power source when said electric heater means is electrically energized.

13. An auger-type ice making machine according to claim 3 wherein said electrically energizing means includes:

a thermostat connected in series to said electric heater means and closed when temperature of said outlet end portion of said refrigerating cylinder becomes lower than a preset level while being opened unless said temperature is lower than said preset level; and a timer for establishing electrical connection between said electric heater means and thermostat and said power source after lapse of a predetermined time when said first relay means is deenergized.

14. An auger-type ice making machine according to claim 13 wherein said control circuit includes a restart inhibit circuitry for preventing said driving motor from being restated so long as said electric heater means is electrically energized by said electrically energizing means.

15. An auger-type ice making machine according to claim 14 wherein said restart inhibit circuitry includes fourth relay means for interrupting electrical connection between said first relay means and said power source when said electric heater means is electrically energized.

16. An auger-type ice making machine according to claim 2 wherein said water supply system includes:

a feed water tank connected to a water supply source by way of a water supply pipe;

a feed water valve installed in said water supply pipe;

a feed water pipe communicating said feed water tank to the interior of said refrigerating cylinder at a lower end portion thereof;

a drain pipe communicated to the interior of said refrigerating cylinder at a lower end portion thereof; and a drain valve installed in said drain pipe.

17. An auger-type ice making machine according to claim 16 wherein said control circuit is so arranged as to close said feed water valve while opening said drain valve in response to detection of opening of said protector by said detecting means.

18. An auger-type ice making machine according to claim 1 wherein said driving motor is equipped with reduction gear means.

* * * * *